US005506653A

United States Patent [19]

Spillane

[11] Patent Number: 5,506,653

[45] Date of Patent: Apr. 9, 1996

[54] 58 SECOND COLOR PRINT PROCESSOR

[76] Inventor: John D. Spillane, 4270 Eastridge Cres, Victoria B.C., Canada, V8Z 6B6

[21] Appl. No.: 48,137

[22] Filed: Apr. 14, 1993

[51] Int. Cl.[6] ..... G03D 3/08

[52] U.S. Cl. ..... 354/320; 354/322; 354/331

[58] Field of Search ..... 354/297–298, 354/319–324, 328, 331, 336, 338; 134/64 P, 64 R, 122 P, 122 R

[56] References Cited

U.S. PATENT DOCUMENTS

| | | | |
|---|---|---|---|
| 3,461,788 | 8/1969 | Tiger et al. | 354/324 |
| 3,752,054 | 8/1973 | Scanlan . | |
| 4,014,289 | 3/1977 | Zimmer | 118/213 |
| 4,034,389 | 7/1977 | Huss | 354/322 |
| 4,099,194 | 7/1978 | Kümmerl | 354/321 |
| 4,354,755 | 10/1982 | Becheiraz | 354/322 |
| 4,461,555 | 7/1984 | Kuzyk et al. | 354/323 X |
| 4,647,173 | 3/1987 | Schär | 354/319 |
| 4,892,057 | 1/1990 | Zimmer | 118/248 |
| 4,922,276 | 5/1990 | Lamprecht et al. | 354/322 X |
| 5,070,351 | 12/1991 | Vanover et al. | 354/322 X |
| 5,255,042 | 10/1993 | Fischer et al. | 354/319 |
| 5,281,989 | 1/1994 | Sitte | 354/320 |
| 5,287,139 | 2/1994 | Inoue | 354/320 |

FOREIGN PATENT DOCUMENTS

| | | | |
|---|---|---|---|
| 622150 | 6/1961 | Italy | 354/313 |

*Primary Examiner*—D. R. Rutledge

[57] ABSTRACT

A photographic processing apparatus comprising two or more chambers having baths for processing photographic material and having at least one immersion roller in each bath for immersing and conveying the photographic material. The immersion roller may be driven by a magnetic coupling arrangement.

14 Claims, 1 Drawing Sheet

58 SECOND COLOR PRINT PROCESSOR

FIELD OF THE INVENTION

The invention relates to a photographic process and apparatus for feeding a photographic material to be processed through a plurality of baths.

SUMMARY OF THE INVENTION

The present invention provides an apparatus for continuous processing of photographic paper. The processor has two or more processing chambers or baths. The processing chambers may contain a processing solution and have lids. The processor includes means for conveying the photographic paper to be processed, comprising rollers to transport the photographic paper and a tube within each processing chamber to immerse the photographic paper in the processing solution. The tubes may also provide some agitation of the processing solutions in each processing chamber. Means may be provided to remove liquid from the photographic paper as the paper exits each chamber. The liquid may be removed from the paper by the squeegee action of the transport rollers. The tubes may be driven by magnetic coupling to a rotatable rod. Magnets may be provided inside the tubes; the magnets inside the tubes being driven by magnets on the rotatable rod. The rotatable rod with magnets on it may be outside the processing chambers and may be driven by a motor.

A thermostat and heater may be provided in order to maintain the solution in a processing chamber at a predetermined temperature.

"Maginot line" bumps may be provided on the inside surface of a processing chamber to reduce friction in the conveyance of the photographic paper and to keep sediment away from the photographic paper.

One of the processing chambers may contain a bleach solution.

A lid may be provided for a processing chamber. The lid of a processing chamber may be adapted to guide the photographic paper into the processing chamber.

The operation of the means employed to convey the photographic paper through the processing chambers may be controlled by a computer.

DETAILED DESCRIPTION OF THE INVENTION

Process Component List

Figure 1:
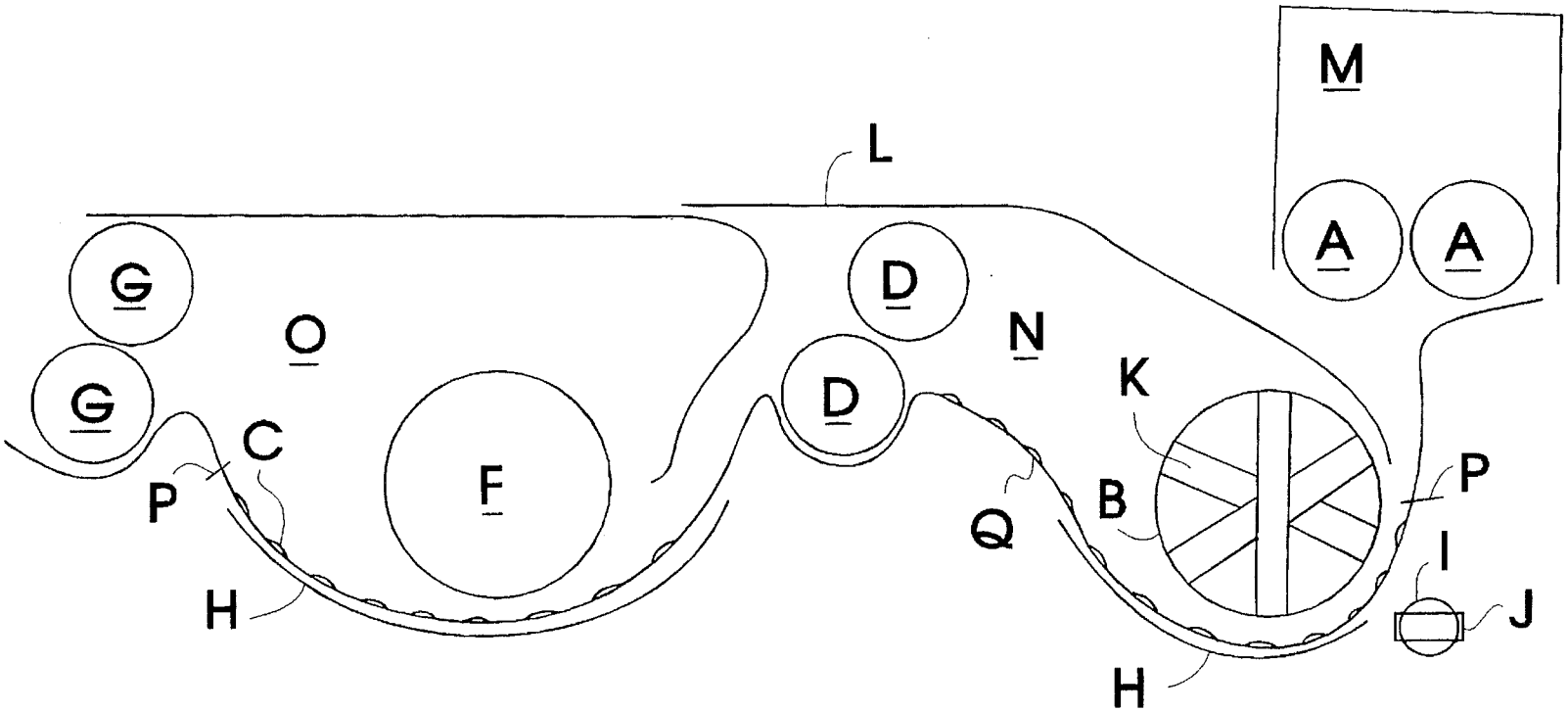
FIG. 1 is a cross-sectional view showing a processing apparatus with two processing chambers and magnetically coupled conveying means according to an aspect of the invention.

A rubber feed rollers;
B magnetically coupled tube;
C "Maginot line" bumps;
D second set of squeegee, transport rollers;
E removable processing chamber lid adapted to guide photographic paper into the second processing chamber;
F tube;
G squeegee, exit rollers;
H heaters;
I motor-driven rotating rod;
J magnets mounted on rotating rod I;

K magnets mounted on tube B;
L removable lid to first processing chamber;
M motor;
N first processing chamber;
O second processing chamber;
P thermostats.

Photographic paper at rubber feed rollers A is transported down into a developer bath in first processing chamber N. The photographic paper is immersed in the developing solution in first processing chamber N by tube B which may be magnetically coupled. The photographic paper exits first processing chamber N through squeegee, transport rollers D which remove excess developing solution from the photographic paper. From the squeegee, transport rollers D, the photographic paper enters second processing chamber O containing a bleach bath solution. The photographic paper is guided into second processing chamber O by the removable lid E of the second processing chamber O. Tube F immerses the photographic paper in the bleach solution. The photographic paper exits the processing apparatus to squeegee, exit rollers G. Further baths may be provided according to the invention for washing the photographic paper. Alternatively, washing may be done externally to the processor of the invention.

"Maginot line" bumps C are formed on the inner bottom surface of processing chambers N, O to improve the conveyance of the photographic paper by reducing friction. Bumps C may also promote better circulation of the processing solutions and reduce aggregation of particulates. The action of tubes B, F may improve mixing in processing chambers N, O, promoting uniform temperatures and improving processing chemistry. Processing solutions may be maintained at a predetermined temperature by heaters H which may be thermostatically controlled by thermostats P.

The tubes in the processing chambers N, O may be magnetically driven, as is shown with respect to tube B. Magnets K are located inside tube B. In FIG. 1, magnets K are shown at approximately 120° angles. Other angles may be chosen. Rotating rod I has magnets J mounted on it. Rod I is magnetically coupled to tube B. Rotation of rod I and magnets J causes rotation of tube B via magnets K.

Motor M drives rollers A, D and G and rotating rod I via linked pulleys, belts and/or gears.

As will be apparent to the those skilled in the art in light of the foregoing disclosure, many alterations and modifications are possible in the practice of this invention without departing from the spirit or scope thereof. For example, tubes B, F may be solid. Rollers A, D, G may be surfaced with some material other than rubber to provide an appropriate mechanism for conveying photographic paper through the processor of the invention. Accordingly, the scope of the invention is to be construed in accordance with the substance defined by the following claims.

I claim:

1. An apparatus for the continuous processing of photographic paper, comprising:

a plurality of processing chambers, each processing chamber containing a processing solution and having a lid;

conveying means comprising rollers to transport the photographic paper and tubes contained in each chamber to immerse the photographic paper in the processing solution;

means to remove liquid from the photographic paper as the paper exits each chamber;

and wherein the tubes are driven electromagnetically by means of magnets located within said tubes and a magnetic rod.

2. An apparatus according to claim 1, further including means to maintain the solution at a predetermined temperature.

3. An apparatus according to claim 2, wherein the means to maintain the solution at a predetermined temperature comprises a thermostat and a heater.

4. An apparatus according to claim 1, wherein at least one of the chambers has "Maginot line" bumps on an inner surface to reduce friction in conveying the photographic paper and to keep sediment away from the photographic paper.

5. An apparatus according to claim 1, wherein one of said chambers comprises a bleach solution.

6. An apparatus according to claim 5, wherein the lid of the chamber comprising the bleach solution also serves as a means to guide the photographic paper down into the bleach solution.

7. An apparatus according to claim 1, wherein the means to remove liquid from the photographic paper comprises squeegee rollers.

8. An apparatus according to claim 1, wherein the conveying means is controlled by a computer.

9. An apparatus according to claim 1, wherein the tubes further serve to guide the photographic paper, to agitate the processing solution and to maintain a uniform processing solution.

10. An apparatus for processing photographic paper, comprising:

a plurality of processing chambers;

rollers adapted to transport the photographic paper into and out of the processing chambers;

a free-floating, rotatable tube in at least one of the processing chambers, the tube being adapted to immerse the photographic paper in a processing solution in the processing chamber.

11. The apparatus of claim 10, further comprising a rotatable rod magnetically coupled to the tube, wherein rotation of the rod causes the tube to rotate.

12. An apparatus according to claim 10, further comprising a lid on a processing chamber, the lid being adapted to guide photographic paper into the processing chamber.

13. An apparatus according to claim 10, further comprising bumps on a bottom, inner surface of a processing chamber.

14. An apparatus according to claim 10, further comprising a bottom inner surface of a processing chamber and a lid on a processing chamber, wherein the bottom inner surface and the lid are shaped to cooperatively guide photographic paper through the apparatus.

* * * * *

UNITED STATES PATENT AND TRADEMARK OFFICE

CERTIFICATE OF CORRECTION

PATENT NO. : 5.506,653
DATED : April 9, 1996
INVENTOR(S) : Douglas Spillane

It is certified that error appears in the above-identified patent and that said Letters Patent is hereby corrected as shown below:

Column 1, line 2, should read:

THIS APPLICATION IS A CONTINUATION IN PART OF PRIOR APPLICATION NO. 07/760,894

Signed and Sealed this

Twenty-first Day of April, 1998

Bruce Lehman

*ttest:*

BRUCE LEHMAN